United States Patent [19]

Masters

[11] Patent Number: 4,480,579

[45] Date of Patent: Nov. 6, 1984

[54] KAYAK WITH ADJUSTABLE ROCKER

[76] Inventor: William E. Masters, P.O. Box 64, Liberty, S.C. 29657

[21] Appl. No.: 398,205

[22] Filed: Jul. 14, 1982

[51] Int. Cl.[3] ..... B63B 35/72

[52] U.S. Cl. ..... 114/347; 114/354; 114/357

[58] Field of Search ..... 114/56, 292, 347, 352, 114/354, 355, 357, 358, 359

[56] References Cited

U.S. PATENT DOCUMENTS

| | | | |
|---|---|---|---|
| 2,152,029 | 3/1939 | Cone | 244/219 |
| 2,612,129 | 9/1952 | Burch | 114/56 |
| 4,229,850 | 10/1980 | Arcouette | 114/347 |
| 4,274,170 | 6/1981 | Simpson | 114/347 |

FOREIGN PATENT DOCUMENTS

| | | | |
|---|---|---|---|
| 552402 | 3/1931 | Fed. Rep. of Germany | 114/354 |
| 1147887 | 12/1957 | France | 114/355 |
| 300366 | 11/1928 | United Kingdom | 114/354 |
| 797948 | 1/1981 | U.S.S.R. | 114/355 |

*Primary Examiner*—Trygve M. Blix
*Assistant Examiner*—Thomas J. Brahan
*Attorney, Agent, or Firm*—Schwartz, Jeffery, Schwaab, Mack, Blumenthal & Koch

[57] ABSTRACT

The kayak includes apparatus for raising and lowering the bow portion and the stern portion of the kayak hull relative to the central portion of the kayak. The apparatus includes a first tension member connected between the central portion of the kayak and the kayak bow, and a second tension member connected between the central portion of the kayak and the kayak stern. The tension on the members may be individually increased or decreased to raise or lower the bow and stern.

14 Claims, 5 Drawing Figures

KAYAK WITH ADJUSTABLE ROCKER

BACKGROUND OF THE INVENTION

1. Field of the Invention

This invention relates to boats which are adapted for use in the sport of white water boating, and more particularly to kayaks which can be adjusted for use in various water conditions.

2. Discussion of Related Art

Kayaking has become a very popular form of white water boating because the kayak is a relatively stable and maneuverable craft. However, for maximum maneuverability, the design of the kayak must conform to the specific water conditions in which it is used. For example, the longitudinal curvature, or rocker, of the kayak is known to affect maneuverability. Generally, in fast white water conditions, the more rocker the kayak has, the faster the boat turns. However, in the western portion of the U.S., where waves may reach eight feet in height, the bow portion of the rocker should be increased and the stern portion decreased to allow the boater to surf the face of a large wave with more control. On the other hand, on the eastern coast of the U.S., where the water is rocky and requires fast turns into eddies, the boater prefers a kayak with a low bow rocker and a higher stern rocker.

At the present time, if a boater changes from one type of water to another, it is necessary to change boats entirely in order to have maximum maneuverability. Consequently, it would be desirable for the boater to be able to change the rocker on a single kayak to adjust the kayak for use in different water conditions.

SUMMARY OF THE INVENTION

One object of the present invention is to provide a kayak in which the kayak rocker can be adjusted.

Another object of the present invention is to provide a kayak with an adjustable rocker wherein the rocker adjustment can be made by the kayaker with a minimum of effort.

A still further object of the present invention is to provide a kayak with an adjustable rocker in which structure for changing the rocker is contained within the kayak hull but does not limit the hull configuration or add significant weight to the hull.

Another object of the present invention is to provide a kayak having an adjustable rocker in which the structure for adjusting the rocker is highly effective in use it can be incorporated in known kayak configurations with relative ease.

In accordance with the above and other objects, the kayak of the present invention comprises a hull with a central portion, a bow portion, and a stern portion, and a longitudinal curvature extending from the bow portion to the stern portion. The longitudinal curvature defines the rocker of the kayak. The improvement comprises apparatus connected to the hull for increasing or decreasing the curvature of the hull thereby adjusting the rocker of the kayak.

The rocker adjustment apparatus comprises structure for raising or lowering the bow portion of the kayak relative to the central portion thereof. The adjustment apparatus also comprises structure for raising or lowering the stern portion of the kayak relative to the central portion thereof. The structures for raising or lowering the bow or stern portions comprise an anchor structure fixed in the central portion of the kayak and elongated members connected between the anchor portion and the bow stern portions, respectively. The elongated members comprise tension members connected to the anchor structure and connected to the bow and stern portions, respectively, at positions below the position of connection of the tension members to the anchor structure, and apparatus for increasing or decreasing the tension of the tension members whereby the bow and stern portions can be raised or lowered.

The structure for increasing and decreasing the tension members includes threaded ends on the tension members and nuts which are received on the threaded ends.

DESCRIPTION OF THE PREFERRED EMBODIMENT

Figure 1:
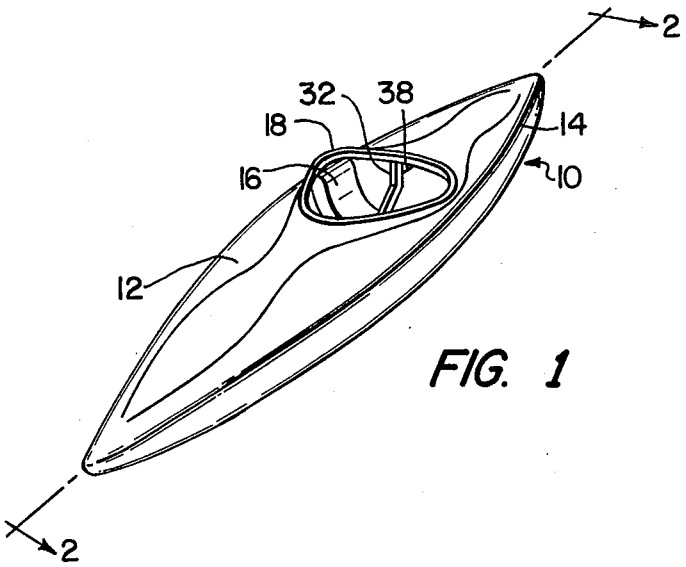
FIG. 1 is a perspective view of a kayak with adjustable rocker according to the present invention.
Figure 2:
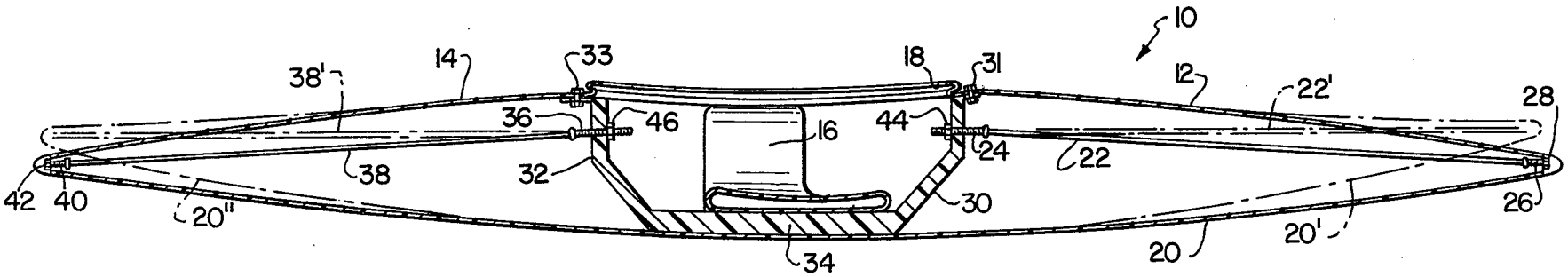
FIG. 2 is a longitudinal sectional view of the kayak of FIG. 1 taken substantially along a plane passing through section line 2—2 of FIG. 1.

FIGS. 1 and 2 show a kayak 10 comprising a hull having a bow portion 12 and a stern portion 14. A seat 16 is disposed in the center portion of the hull and is accessible through a cockpit opening 18. The hull also includes a longitudinal curvature, defined by a curved lower surface 20, which extends from the bow to the stern of the kayak and defines the kayak rocker.

Kayak 10 is formed with a semi-flexible skin so that the bow and stern portions of the kayak can flex up or down slightly thus changing the rocker of the kayak. Kayaks of this type can be made from synthetic resin materials such as polyethylene or other materials of similar stiffness. Preferably, the kayak is formed by a rotational molding process.

An elongated tension element 22 extends from the central portion of the kayak to the extreme point of the bow 12. Element 22 can be a metallic cable such as aircraft cable or the like. A threaded termination member 24 is attached to one end of cable 22 and a second threaded termination member 26 is attached to the opposite end of cable 22. A nut 28 is embedded in the tip of the bow of the kayak and threaded termination member 26 is screwed into nut 28. Threaded termination member 24 is passed through an opening in a retaining member 30. Retaining member 30 is part of an anchor structure which is mounted in the central portion of kayak 10. The anchor structure comprises retaining member 30, a retaining member 32 and a base 34. The anchor structure can be formed of fiberglass, metal or any other firm material. Base 34 extends under seat 16, and a groove can be formed in the bottom of the seat for this purpose. Retaining member 30 is attached to the top of the hull by a nut and bolt connection shown at 31 which passes through the top of the hull and through a small extension on retaining member 30. Similarly, retaining member 32 is connected to the top of the kayak hull by the use of a nut and bolt connection shown at 33. Retaining members 30 and 32 are relatively thin and disposed in the lateral center of the kayak so that a kayaker may place his legs on either side of one of the retaining members. Seat 16 is designed to extend upward along the sides of the kayak and terminate just below a lip around the cockpit opening 18. This forces seat 16 downwardly onto base 34 and helps hold the anchor structure in position. Also, seat 16 aids in keeping the center of the kayak rigid. Further, the anchor structure aids in improving the kayak rigidity since retaining members 30 and 32 extend from the top of the kayak hull to the bottom of the hull.

The structure in the stern 14 of the kayak is similar to that in the bow 12, and comprises a threaded connector 36 mounted to one end of a cable 38. The opposite end of cable 38 contains a second threaded connector 40. Threaded connector 40 is received in a nut 42 which is embedded in the extreme stern of the kayak. Threaded connector 36 extends through a hole in retaining member 32. The free ends of threaded connectors 24 and 36 receive nuts 44 and 46. Clearly, the tension on cables 22 and 38 can be adjusted by simply rotating nuts 44 and 46, respectively. In order to facilitate the tension adjustment, nuts 44 and 46 can be wing nuts or the like. Preferably, the kayak 10 is formed with a rocker which is the lowest desirable and is suitable for the maximum number of water conditions which would be encountered. The position of threaded connectors 24 and 36 is placed above the vertical position of connectors 26 and 40, respectively. Accordingly, when the tension on cables 22 and 38 is increased, the bow and stern, respectively, of the kayak are raised. By simply decreasing the tension on the cables, the bow and stern, respectively, of the kayak can then be lowered again.

Clearly, in operation, with the kayak hull in its relaxed position as shown in FIG. 2, if the kayaker is to encounter high waves, the bow of kayak 10 can be lifted to the raised position shown at 20' by merely rotating nut 44 to increase tension on cable 22. This produces an upward component of force at nut 28 which causes the bow of kayak 10 to rise until cable 22 is approximately horizontal.

On the other hand, if the water is rocky and requires fast turns, the bow of kayak 10 can be dropped and the stern raised by rotating nut 46 to increase the tension on cable 38. This causes the stern of kayak 10 to rise to a position shown at 20''.

In mid-class waters, both the bow and stern can be raised, and then lowered again when the boater reaches calm water to obtain better directional stability.

Figure 3:
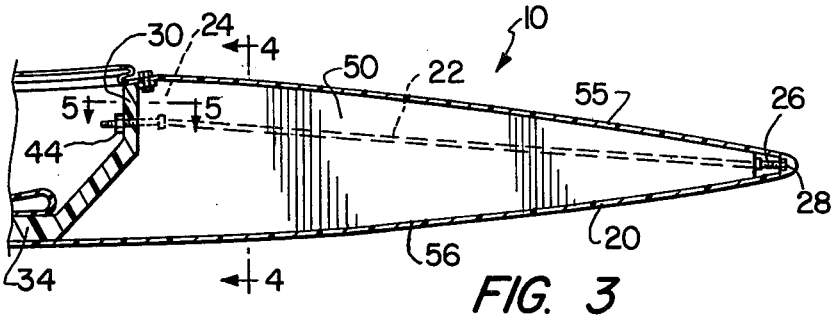
FIG. 3 is a part fragmentary view of the kayak bow with adjustable rocker and a frame pillar.

Kayak framework systems are known for lending structural support to a kayak. One such framework system which has been found to be extremely effective is disclosed in U.S. application Ser. No. 263,562, the disclosure of which is hereby incorporated by reference. The major components of such a framework system can be used in the present invention in conjunction with the adjustable rocker. FIG. 3 shows the bow of a kayak having a framework system incorporated therein. Only the bow is shown in FIG. 3, it being understood that the stern portion of the kayak will have an identical framework construction.

Figure 4:
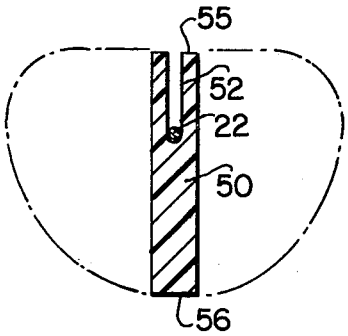
FIG. 4 is a front elevational sectional view taken along line 4—4 of FIG. 3.
Figure 5:
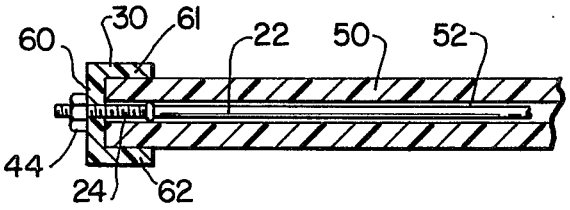
FIG. 5 is a top plan sectional view taken along line 5—5 of FIG. 3.

As shown in FIGS. 3–5, the framework system essentially comprises a long thin beam 50 which is disposed upright in the lateral center of kayak 10 and has upper and lower edges 55 and 56 which extend along and contact the inner surfaces of the upper and lower walls of the kayak. Beam 50 is relatively narrow as compared to the overall width of the kayak so that a kayaker may place his or her legs on either side of the beam. Beam 50 is produced from an expanded foam material, preferably expanded polyethylene foam. The material is lightweight and strong, yet is sufficiently flexible so that beam 50 can flex vertically to accommodate the kayak rocker adjustment.

In order to keep beam 50 from sliding longitudinally toward the center of kayak 10, the beam abuts against retaining member 30 of the anchor structure. For this purpose, as shown in FIG. 5, retaining member 30 is formed with a generally U-shaped configuration with end piece 60 abutting against the end of beam 50 and sides 61 and 62 abutting against opposite sides of beam 50. In this manner, beam 50 is held relatively immobile within the kayak hull.

In order to ensure freedom of movement of cable 22, a deep groove 52 is formed in the top edge 55 of beam 50 to accommodate the cable. Groove 52 allows cable 22 to move up and down slightly relative to beam 50 when the rocker of the kayak is adjusted. Groove 52 extends for the entire length of beam 50 and has a depth at least sufficient to allow cable 22 to extend directly between its mounting position on retaining member 30 and its mounting position in the bow of kayak 10 when the cable is in its relaxed position and the kayak rocker has the least amount of curvature.

As discussed above, the anchor structure comprising retaining members 30, 32 and base 34 adds rigidity to the kayak due to the fact that it extends between the top and bottom of the kayak and thus reduces the likelihood that the kayak would collapse if it is pinned on a bridge, tree or the like. By providing pillars such as pillar 50 in the bow and stern of the kayak, the structural rigidity of the kayak is increased even further. Each pillar 50 is essentially connected to and held in place by one of the retaining members 30, 32 by virtue of sides 61 and 62, as shown in FIG. 5. Finally, cables 22 and 38 further improve the structural integrity of the kayak and help to maintain each beam 50 in place within its associated retaining member.

By forming beam 50 from expanded polyethylene, or other flexible expanded foam material, the adjustable rocker function provided by cable 22 is not at all hindered. It is to be noted here that a change in the overall curvature produced by bending the bow or stern of a kayak by only one inch produces a noticeable effect in the handling of the kayak. Consequently, the combined structure provides both increased versatility and maneuverability to the kayak as well as significantly improving the kayak's structural rigidity thereby improving both the enjoyment and safety of the sport of kayaking.

The foregoing description has been set forth for the purpose of illustrating the present invention but is not meant to limit the scope of protection in any way. Clearly, numerous modifications, additions and other changes can be made to the present invention without departing from the scope and spirit thereof. For example, the position of mounting threaded connectors 24 and 36 could be placed below the vertical position of threaded connectors 26 and 40, in which case, when the tension on cables 22 and 38 is increased, the bow and stern portions of the kayak would be flexed downward. Any such changes are meant to be within the scope of the invention, as set forth in the appended claims.

What is claimed is:

1. A rotationally molded kayak having a hull with a top, a bottom, a central portion, a bow portion, and a stern portion, said hull having a longitudinal curve, said longitudinal curve defining the rocker of said kayak, the improvement comprising:

means connected to said hull and extending from a central portion in said hull to one end of said hull for increasing or decreasing the longitudinal curvature of said hull thereby adjusting the rocker of said kayak, said rocker adjustment means comprising means for raising or lowering the entire end of said kayak to which said means is connected relative to the central portion of said kayak.

2. The kayak as set forth in claim 1, wherein said bow raising or lowering means comprises an anchor structure fixed in the central portion of said kayak, and an elongated member connected between said anchor structure and said bow portion of said kayak.

3. The kayak as set forth in claim 2, wherein said anchor structure comprises a first retaining member extending between the top and bottom of the kayak in the central portion of the kayak, a second retaining member longitudinally spaced from the first retaining member and extending between the top and bottom of the kayak in the central portion of the kayak, and a base member connecting said first and second retaining members along the bottom portion of the kayak, said first and second retaining members and said base member being relatively rigid, thereby improving the structural rigidity of the kayak.

4. The kayak as set forth in claim 3 or claim 1, and further including frame members comprising beams disposed in the bow portion and stern portion of said kayak, said beams extending between the top and bottom of said bow and stern portions, respectively, for increasing the structural rigidity of said kayak.

5. The kayak as set forth in claim 2, wherein said elongated member comprises a tension member connected to said anchor structure and connected to said bow portion at a position below the position of connection of said tension member to said anchor structure, and means for increasing or decreasing the tension on said tension member.

6. The kayak as set forth in claim 5, wherein said tension member includes a threaded end, and said tension increasing or decreasing means comprises a nut connected to said threaded end.

7. The kayak as set forth in claim 2, and further including means for raising and lowering the stern of said kayak comprising an elongated member connected between said anchor structure and said stern portion of said kayak, and further including a first structurally supportive beam member connected between said anchor structure and said bow of said kayak for supporting the bow portion of said kayak, and a second structurally supported elongated beam member connected between said anchor structure and the stern of said kayak for supporting the stern portion of said kayak.

8. The kayak as set forth in claim 7, wherein said anchor structure comprises a first U-shaped member holding said first beam member, and a second U-shaped member holding said second beam member.

9. The kayak as set forth in claim 8, wherein said first and second beam members contain longitudinal slots which receive said elongated members.

10. The kayak as set forth in claim 9, wherein said elongated members are cables.

11. The kayak as set forth in claim 1, wherein said rocker adjustment means comprises means for raising or lowering the stern portion of said kayak relative to the central portion of said kayak.

12. The kayak as set forth in claim 11, wherein said stern raising or lowering means comprises an anchor structure fixed in the central portion of said kayak, and an elongated member connected between said anchor structure and said stern portion of said kayak.

13. The kayak as set forth in claim 12, wherein said elongated member comprises a tension member connected to said anchor structure and connected to said stern portion at a position below the connection of said tension member to said anchor structure, and means for increasing or decreasing the tension on said tension member.

14. The kayak as set forth in claim 13, wherein said tension member includes a threaded end, and said tension increasing or decreasing means conmprises a nut connected to said threaded end.

* * * * *